United States Patent [19]

Resh

[11] 4,130,747

[45] Dec. 19, 1978

[54] MINIATURE OVERTRAVEL SNAP ACTION SWITCH WITH PIVOTAL CAM MOUNTING FOR THE SWITCH BLADE

[75] Inventor: John S. Resh, Valparaiso, Ind.

[73] Assignee: McGill Manufacturing Company, Inc., Valparaiso, Ind.

[21] Appl. No.: 841,477

[22] Filed: Oct. 12, 1977

[51] Int. Cl.[2] ..... H01H 21/04

[52] U.S. Cl. ..... 200/67 D; 200/159 A

[58] Field of Search ..... 200/67 R, 67 B, 67 C, 200/67 D, 67 DA, 153 L, 159 A, 67 DB

[56] References Cited

U.S. PATENT DOCUMENTS

| | | | |
|---|---|---|---|
| 2,460,087 | 1/1949 | Hollis | 200/67 D |
| 2,513,804 | 7/1950 | Kaminky | 200/67 D X |
| 2,695,524 | 11/1954 | Eaton | 200/67 D X |
| 3,187,132 | 6/1965 | Dennison | 200/67 D |
| 3,291,930 | 12/1966 | Hipple | 200/67 D |
| 3,336,449 | 8/1967 | Ashman | 200/67 D |
| 3,532,840 | 10/1970 | Bauer | 200/67 D |
| 3,578,926 | 5/1971 | Oberman | 200/67 D |
| 3,838,237 | 9/1974 | Hoshioka | 200/67 DA |
| 3,878,347 | 4/1975 | Roeser | 200/67 D |

FOREIGN PATENT DOCUMENTS

| | | | |
|---|---|---|---|
| 450521 | 4/1968 | Switzerland | 200/67 DA |
| 614812 | 12/1948 | United Kingdom | 200/67 D |
| 833336 | 4/1960 | United Kingdom | 200/67 D |

*Primary Examiner*—Herbert F. Ross
*Attorney, Agent, or Firm*—Foorman L. Mueller

[57] ABSTRACT

A miniature snap action electrical switch has a member fixedly supported in the switch housing which serves both as a common terminal for the switch and a mount for the switch blade structure. The switch blade structure includes the switch blade and a pivotal cam, and the switch blade has an integral tongue between two arched legs connecting a bridging portion at one end and a contact portion at the other. The tongue mounts in a notch in one face of the combination member, and the pivotal cam has a cam edge which engages the combination member on its opposite face. The switch blade is connected with the pivotal cam at the end of such cam opposite to the cam edge and is tensioned when so assembled in a mounted free position for the switch. When the bridging portion is depressed by an operating force in a switching operation, the cam pivots in a rolling action and travels a small linear dimension on the face of the combination member while the tongue of the blade is in a fixed mounted position on the opposite face of such member. The blade operates with a light force and yet exerts a large contact force at the contact and corresponding terminal. There is a minumum change in the length of the arched blade when it is tensioned or stressed as the blade is moved through an operating cycle. This minimum change contributes to lesser metal fatigue in blade and a longer life for the switch, while the large contact force at the terminal and a light operating force provide important characteristics in the switch.

8 Claims, 9 Drawing Figures

MINIATURE OVERTRAVEL SNAP ACTION SWITCH WITH PIVOTAL CAM MOUNTING FOR THE SWITCH BLADE

BACKGROUND OF INVENTION

Miniature snap action switches have found a ready application in a long list of products including counters, timers, door interlocks, thermostats, and equipments operating according to thermostatic control, valve controls, photocopy equipment, data processing equipment, calculators, recorders, record players, vending machines and the like. The usefulness of the switch results from a small size, from a variable operating force depending upon the mechanism of the switch, and from a relatively low cost.

In operating equipments in which the switches control the electrical circuit operation of the equipment, the mechanical and electrical characteristics required for the equipments vary significantly. For instance, door interlocks operating relatively few times a day in a fixed stable mounting, with an excessive operating force available, and with a stable contact position either in a closed-circuit or open-circuit position, provide conditions for a long life for the miniature snap action switch. However, in applications for the switches which are less stable, or are in portable or in moving equipments there can be bouncing at the contacts or breaking of contact unless a substantial force maintains the contact in circuit closing position. The contact force in turn affects the current carrying capacity at the contact and hence that characteristics of the switch, for the better and more secure the contact the greater the current carrying capacity. The available operating force will vary from application to application in equipments, but generally a light operating force is very desirable in many applications.

Normally, for such switch applications, that which provides the longest life so as to minimize replacement and maintenance for such switches in the equipment is the most acceptable. Acceptability is further enhanced with a low operating force for the switch and a maximum contact force to provide a large current carrying capacity, all at a reasonable cost. In the prior switches of this type these three characteristics are not maximized, and there is a need in the industry for a switch at a reasonable cost that does maximize all such requirements.

SUMMARY OF INVENTION

In the prior snap action switches of the overcenter type, the spring action switch blade is mounted and maintained at two displaced fixed points, and is under tension. When the blade is moved by an operating plunger to change the contact on the blade from a free position to an overtravel position, the switch blade is further tensioned such that the blade and contact automatically return from the overtravel position to the free position when the operating plunger is released. The tension or stress change during operation of the prior switch blade is substantial and results in a metal fatigue which causes the blade to break and thereby affects the life of the switch.

The switch blade of the present invention has an arched portion and is mounted with only one fixed position. The switch blade is loaded or assembled in a switch housing by stretching and tensioning the same between that one fixed position and a connection with a moveable cam. The cam engages a face of a stationary fulcrum with a rolling action over a small linear dimension and tension increases in the switch blade when a plunger operates the switch blade to full overtravel position. That change in tension evidenced in stretching of the arched portion of the blade is very slight. When the plunger is released that developed tension returns the blade and a contact thereon to free position in the switch, and it is ready for another operating cycle.

The moveable cam at its engaging edge or face corresponds to the segment of a circle and when that face engages and rolls against the fulcrum in the operation of the switch blade the cam moves linearly on the fulcrum and provides different tangential pivot points longitudinally of the fulcrum face. This is in contrast to fixed pivot or mounting positions for each end portion of the blades of the prior art. Even though the switch blade as a whole in the present switch is under tension so that the overcenter return action is accomplished, there is a small change in the stress or tension in the blade as the point of contact for the cam edge moves up and down on the fulcrum, an the pivotal movement of the cam is essentially without friction. This small change in the tensioned position of the blade reduces metal fatigue in the blade and provides longer life as well as advantages in the operating characteristics of this switch.

With the switch mechanism of the present invention effecting the stretching of the arched blade and increase in tension with only a small change in the blade position while operating the switch blade from free to overtravel position, the required operating force has been found to be less than that in the prior switches, and the contact force at a circuit terminal is greater. These characteristics means that the switch can be used in a wider range of applications than the prior switches while providing the benefits of longer life and a greater current carrying capacity for the switch.

More specifically; whereas the prior switches of this type employed only fixed mounts or fixed pivotal mounts for a tensioned switch blade having an arched configuration longitudinally of the blade, the blade of present invention is tensioned initially with only one fixed mount, and the second mount is a pivotted rolling cam. The pivotted cam provides a rolling movement for a depressible end portion of the blade while the other end portion of the blade has a fixed mount. The rolling movement for the pivotal mount of the depressible portion of the switch blade causes the cam face to move a linear dimension on its fulcrum and the arched blade changes or stretches at the arched portion in a direction longitudinally of the blade. The initial tension is increased as a tension develops during the overcenter action when the blade breaks contact at its free position or the normally closed circuit position, and sufficient tension or stress builds up to return the contact to such free position when the operating force is removed. As a result of the rolling movement in a linear direction of the cam edge on the fulcrum, there is materially less movement in a direction at right angles to the general longitudinal position of the arched switch blade than in the prior switches with less bending of the blade at such arched position.

Thus, the feature of the present invention is a rolling cam which connects with and retains one end portion of a switch blade in a rolling pivot while the other portion of the blade has a fixed mount. The blade is thus tensioned when assembled, and the cam pivotally engages at one edge or face a combination support and terminal member fixedly mounted in the switch case or housing. A large contact force at the switch blade contact and the active circuit terminal permits a high current carrying capacity at such contact and through the blade to the common terminal member serving as a pivot mount for the cam. This construction has only a very small friction factor at the mounting and in the operation of the blade, and a small operating force relative to prior switch of this type is ample. Such desirable mechanical characteristics of the present invention and a greater current carrying capacity at the contact make it possible to use the switch in a greater number of different equipment applications from both a mechanical standpoint and an electrical standpoint.

DESCRIPTION OF A SPECIFIC EMBODIMENT

Figure 1:
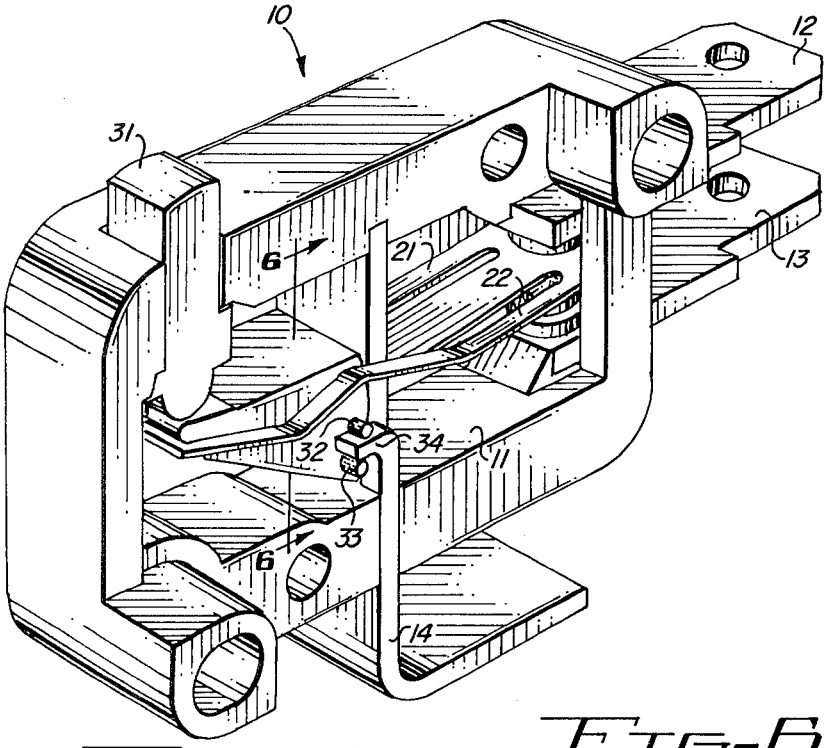
FIG. 1 is a perspective view of the assembled switch with the cover removed from a commercial embodiment thereof and enlarged approximately four times the size of the actual switch.
Figure 2:
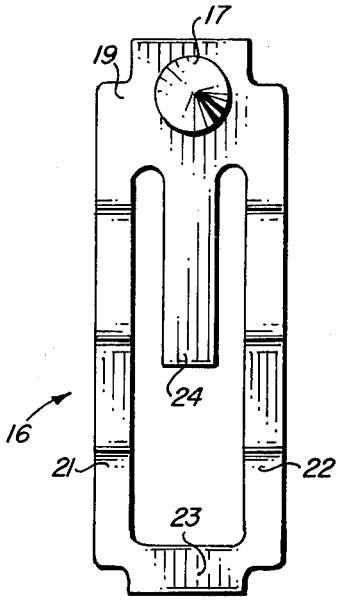
FIG. 2 is an enlarged plan view of the switch blade.
Figure 3A:
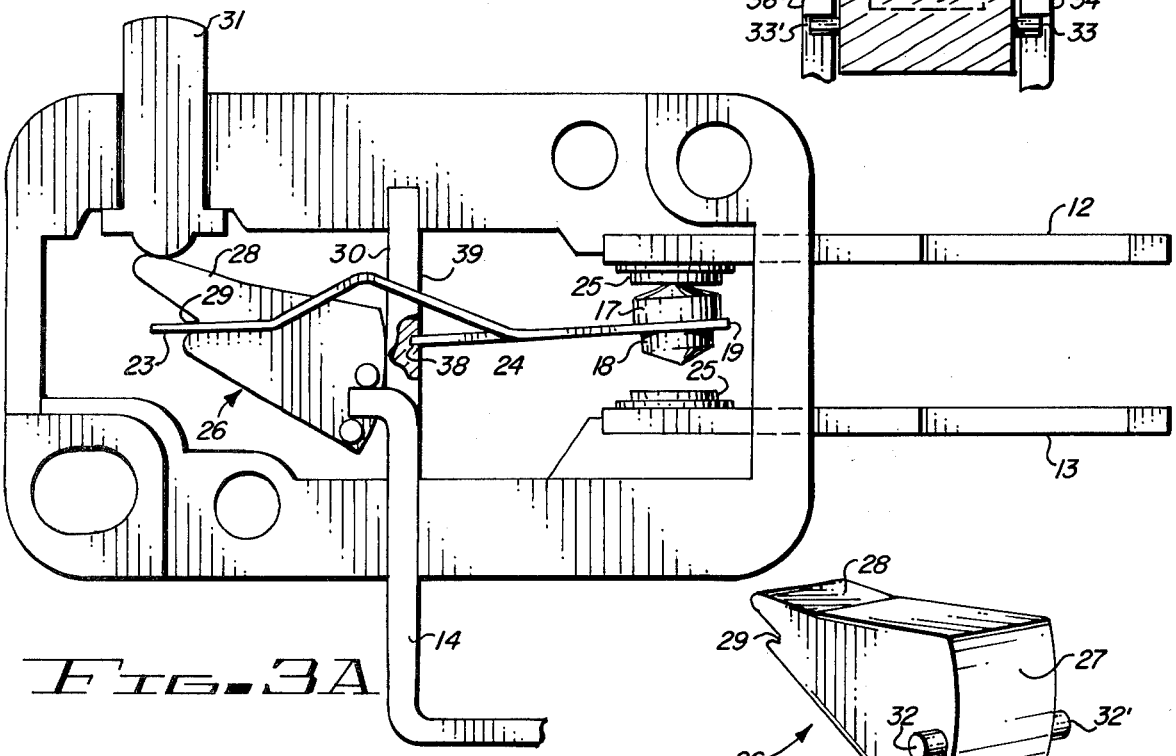
FIG. 3A is a side view of the switch of FIG. 1, to a scale more than five times actual size with the switch blade in a so-called free position, and showing a cutaway portion for the fixed mount for said blade.
Figure 7:
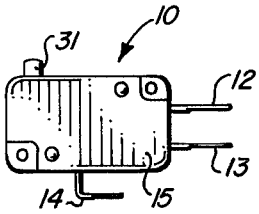
FIG. 7 is a plan view substantially in actual size of the complete switch of FIG. 1 and for the specific embodiment described herein with the housing closed.

Referring to FIGS. 1 and 3A in particular, the switch 10 comprises a housing of insulating material with an internal cavity 11 to house the operating mechanism for the switch. Metal terminals 12 and 13 project from one end of the housing in fixed positions therein, and a metal member 14 is likewise secured in the housing and performs two functions, that of a common electrical terminal for a circuit through terminal 12 and such terminal 14, for instance, and that of a fulcrum or support for oppositely disposed portions of the one-piece switch blade 16 of beryllium copper. The latter operates with an overcenter snap action as generally described in the preceding section of this specification. The housing is closed with an insulating cover 15 (FIG. 7). The blade 16 (FIG. 2) consists of two portions, a contact portion which includes contacts 17 and 18 on opposite faces of the spring balde at that end 19, and a bridging portion 23 closing the two arched legs 21 and 22 at that end just as the contact portion 19 connects such legs 21 and 22 at the opposite end. An integral tongue 24 extends inwardly from the contact end 19 intermediate the legs 21 and 22. The terminals 12 and 13 each have a fixed contact element 25 at the inner end thereof within the cavity 11 in the switch housing.

Figure 3B:
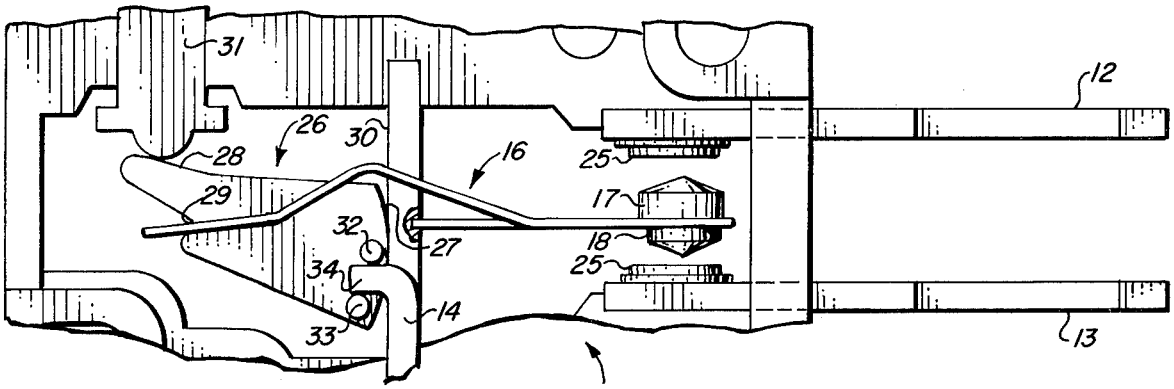
FIG. 3B is a view like FIG. 3A with the switch blade and contact at a so-called operating point which generally is that point where the blade is ready to move to overtravel position.
Figure 3C:
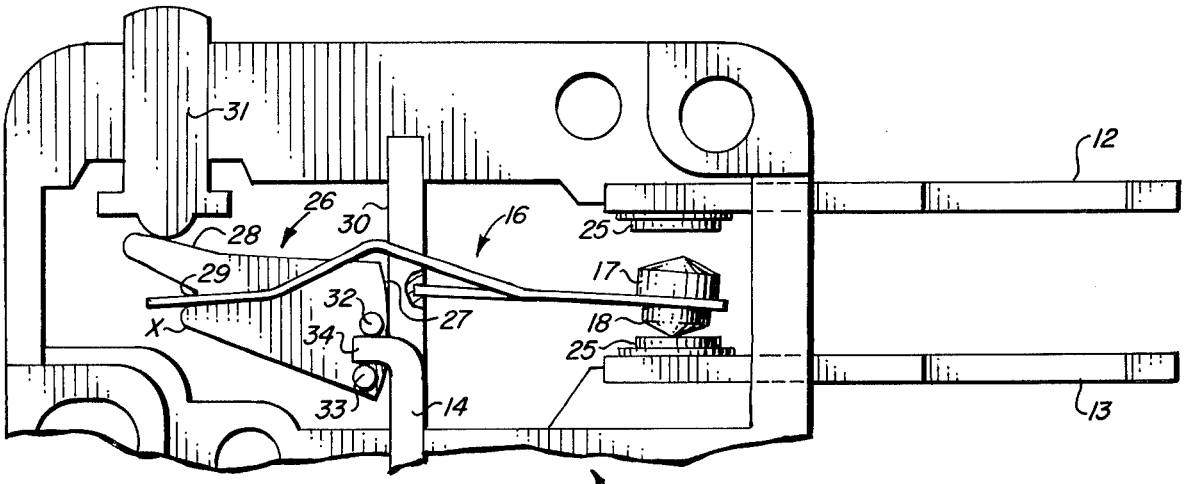
FIG. 3C is a similar view to that of FIG. 3A with the blade in full overtravel position.

The housing, the fixed terminals 12 and 13, the beryllium copper switch blade 16, and a common terminal extending out of the housing as the body and the outer portion of the terminal 14 are similar to corresponding elements in prior switches of this general type. The great improvement in the switch of the present invention over the prior switches is represented in the pivotal cam 26 which in combination with the particular terminal and fulcrum 14 loads, and supports or mounts the switch blade 16 under tension in position in the switch 10. When operated, this mechanism causes the blade 16 to move from the free position of FIG. 3A, through an operating point position of FIG. 3B to the overcenter or overtravel position of the switch blade as shown in FIG. 3C. At this position a stress or force has been built up in the blade which returns it to the position of FIG. 3A.

Figure 5:
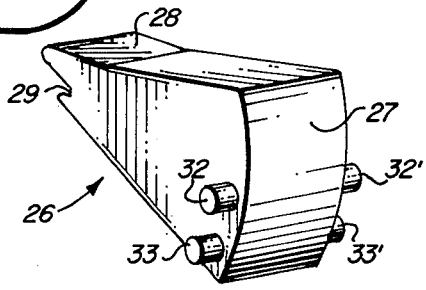
FIG. 5 is an enlarged perspective view of the rolling pivot cam.

As shown in FIG. 5 the pivotal cam 26 comprises a molded plastic part, or it may be a metal part depending upon which material is preferred for a particular embodiment of the invention. The cam has a smooth edge or face 27 which is shaped to correspond with the segment of a circle drawn from a center, which in this embodiment is 0.020" to the left of point X shown in FIG. 3 and down .010" from a line extending from point X. This configuration for the cam face 27 provides a camming action to stretch and tension the switch blade 16 when it is depressed to the position of FIG. 3C.

More specifically, the pivot cam 26 as shown in FIG. 5 has a front edge or face 27 in the position of FIG. 3A which corresponds to the segment of a circle, but with the center of that circle positioned to the left and down from the point X, a camming action results when engaging the face 30 of the fulcrum 14. The back portion of the pivotal cam 26 is a platform 28 and has a notch 29 cut into and across such back edge below such platform. The platform 28 accommodates the operating plunger 31 as shown in FIGS. 1 and 3A to 3C inclusive.

Figure 6:
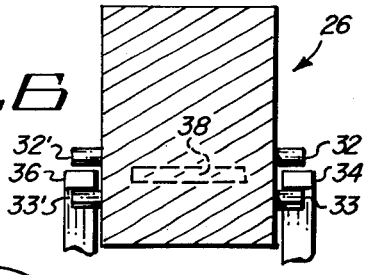
FIG. 6 is a fragmentary cross-section of the fulcrum for mounting the blade and the cam taken at the line 6—6 in FIG. 1.

The cam 26 also includes ears 32 and 33, and 32' and 33' extending outwardly at right angles from each side at the front part of the cam (FIGS. 5 and 6). In a loaded or assembled position for the cam and the switch blade, and in an operation as shown in FIGS. 3A to 3C, the four pins straddle and are spaced away slighly from corresponding tabs or ears 34 and 26 formed out of the metal of the member 14. The tabs or ears 34 and 36 extend rearwardly as viewed in the various assembled illustrations and serve as stops for the cam 26 to prevent vertical displacement of such cam out of its operating position on the rearward face 30 of such fulcrum. This will be explained further in describing the operation of the switch.

Figure 4:
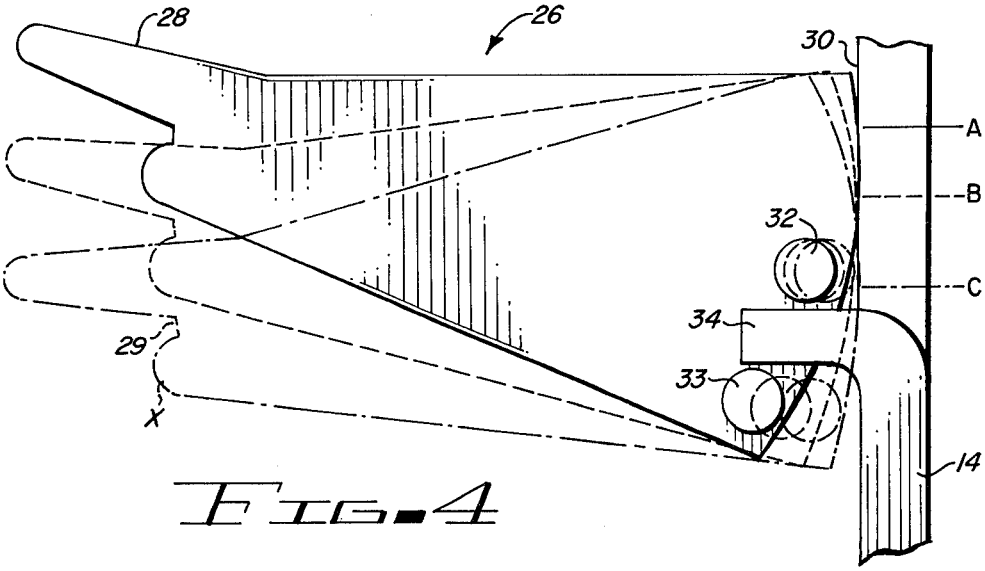
FIG. 4 is a fragmentary somewhat diagrammatic illustration enlarged in a ratio approximately 15 to 1 showing the three points of tangency for the pivotal cam corresponding to the three positions of such cam at the fulcrum as illustrated in FIGS. 3A to 3C.

It must be understood that this switch is miniature in size, the housing as shown in FIG. 7 having outside dimensions of 1.094" long, 0.625" high as viewed in such Figure, and 0.406" deep. Therefore, it is not possible to illustrate the parts accurately in the present drawings which have been enlarged substantially for a better understanding of the parts and the assembly. The switch blade 16 is 0.348" long from the inner end of the tongue 24 to the center of the contact 17, and the length of the blade in the arched configuration of FIG. 2 and prior to assembly is 0.619" from the center of the contact to the back edge (or bottom edge) in FIG. 2. The fragmentary illustration of FIG. 4 is enlarged on an even greater scale which was necessary to show the points of engagement of the cam on the fulcrum.

With the switch blade 16, the cam 26, the operating button or plunger 31 in the position shown in FIG. 3A, and the contact 17 in free position a circuit is completed through the terminal 12, a contact 25 and contact 17, the legs 21 and 22 of the switch blade and the common fixed terminal member 14. As the plunger 31 is depressed manually, or by a motor-driven element, or other means in the equipment in which the switch is being used, the cam 26 pivots through the socalled operating point shown in FIG. 3B to the full overtravel position in FIG. 3C. The contact 18 is then in engagement with the other contact portion 25 on the normally open terminal member 13. The tongue 24 projects into a notch 38 on the face 39 of the member 14 (FIG. 3A) opposite the face 30 described. The legs 21 and 22 formed in arched configurations are stretched when the bridging portion 19 of the blade is inserted in or connected with the notch 29 in the rear end of the cam. This total tensioned assembly maintains the tongue 24 in the notch 38 on one side of the fulcrum 14 and the cam edge or face 27 in engagement with the other side 30.

The pins 32, 33, 32' and 33' on the cam do not touch the tabs 34 and 36 (FIG. 6) in the normal operating positions for the cam. They are utilized in the switch mechanism to prevent a linear displacement of the cam 26 on the fulcrum face 37 in the event that the switch is subjected to a sharp jar, physical shock, or the like. Shock loads resulting from the mass or weight of the contacts and the switch blade can cause problems, but the pins and ears loosely related in normal operating position and do not add friction to or in any way prevent free pivotal movement of the cam 26. High shock loads can also break the electrical and mechanical contact at the contacts 17 and 25, but this mechanism provides a high contact force at this point which has been found to withstand such shocks, and vibration at the contacts is also avoided by such high contact force. Contact bounce is also an undesirable condition occurring when contacts move from one position to the other in a bounce like a rubber ball on a hard surface, but this condition is greatly reduced in the present switch by a high contact force which maintains good circuit continuity.

In the present switch the rolling pivot cam 26 causes the point of engagement to move very slightly on the face of the fulcrum without adding additional stress to the blade. The blade is stretched only about 0.002" in this specific embodiment due to this rolling pivot. Translated into percentage of change relative to a prior art switch of this type, the present switch has about a 25% change as against about 68% change from minimum to maximum stress or tension in the prior switch. The linear change in position of the arched portion of the blade due to the rolling movement on the fulcrum face 30 is 0.002" for the present blade as against a change of 0.007" for the prior switch blade as it goes from free position to overtravel position. This small change reduces the metal fatigue factor to a minimum.

The change in the pivot position as switching occurs is illustrated in FIG. 4 with the cam 26 shown in three pivotted positions, the first as FIG. 3A with a point of trangency at A, the second as FIG. 3B with a point of tangency at B on the face 37, and the overtravel position in FIG. 3C with that point of tangency at C. The cam is shown in full lines for point, A in dashes for point B, and in dots and dashes for point C. This rolling movement taking the cam face over a linear dimension of 0.002" is accomplished while creating only a small additional stress in the blade and is a principal advantage of the present switch that contributes to its extended life. Correspondingly, the small stress change in the blade makes possible a light operating force.

The current carrying capacity of the type of switch of the present invention is dependent upon various factors, but one of the principal factors is the contact force applied where the moveable and stationary contacts meet as at contact 17 and contact 25. The thickness of the beryllium copper of blade is a factor in the current carrying capacity of the switch, and the thickness is also a factor in the operating force required. The following results have been obtained with the present switching mechanism:

| Blade Thickness | Operating Force | Electric Rating | Contact Force |
|---|---|---|---|
| .0046" | 25 grams | 5 amps | 15 + grams |
| .0058" | 50 grams | 10 amps | 30 + grams |
| .0066" | 75 grams | 15 amps | 45 + grams |

"Electric rating" or the current carrying capacity of the switch is dependent upon the contact force.

The operating force of the present switch in the preceding table is that necessary to overcome friction and includes the energy to change the blade stress level. Because the switch blade is nearly symmetrical for all operating positions because of the slight change in stress and the linear position of the arched portion, the initial force to operate the switch of the present invention is almost equal to the contact force on the normally closed side of the switch at contacts 17 and 25. There is little friction in the rolling cam and there is only a small change in stress level, as has been described, and together these factors make possible a light operating force for the switch.

An improved dead band characteristic of the switch of the present invention is likewise significant in the commercial acceptance of the same. "Dead band" is often referred to as "dead force" or "dead break" and by any name is defined as the measured travel distance of the moveable contact wherein no circuit exists. In the present switch, the contact is closed in the normal operating position for the switch and actuation of the cam and blade breaks that contact and the circuit through the contact. At the beginning of movement of the operating plunger to effect such change there is a point where there exists no contact between the terminal member for the free position and the common terminal member of the switch, but switching has not yet occurred. This is measured in a linear measure in thousandths of an inch and the switch is actually dead at that point in its operation. It is an undesirable characteristic that is present in many commercially employed snap switches. In a system such as that for an air conditioner which cuts in when the temperature reaches a certain level and cuts out when the temperature drops a certain amount with cooling the system will go dead at that point in the cycle of operation for the switch because no switching has occurred. This hesitation at the "dead break" will not allow a system to continue to drive and will not give the characteristic on the other side of the line to reverse the operation such as to cut off the cooling because the thermostat control has been satisfied, and there will be nothing to cause operation of the switch to get the system back to its cycle of operation. This can be overcome by the uss of two or more switches which are properly set to avoid such a condition, or the use of a switch which does not have a "dead break." However, experience has indicated that these solutions on presently available snap action switches increase the cost. Such problems can be prevented with the present switch which does not have a "dead break."

Accordingly, the present switch with a pivotal rolling cam mount for one end portion of the switch blade, and a fixed pivotal mount for the other, provides longer life for the switch in comparison with prior switches, permits a lighter operating force, and provides a larger contact force to in turn enhance the current carrying capacity of the switch.

I claim:

1. In a snap action overcenter type switch including a tensionable switch blade having two oppositely disposed end portions, a stationary mount having oppositely disposed faces for mounting said switch blade in said switch, with one end portion of said switch blade being in operative connection with one of said faces of said stationary mount in a fixed pivot mounting and the other of said faces of said stationary mount having a non-recessed portion, said other end portion of said switch blade being in operative connection with said other face of said mount at said non-recessed portion, the improvement comprising said latter operative connection which comprises a cam with a cam edge having a portion thereof of a rounded configuration which engages said other face of said stationary mount in a rolling movement, said cam connecting with said switch blade at a portion thereof displaced from said cam edge, with said cam edge in the operation of said switch rolling over a linear dimension longitudinally of said other face at said non-recessed portion and pivoting at a plurality of points over said linear dimension, and said cam correspondingly moving said switch blade upon said rolling movement of said cam edge.

2. In the switch of claim 1 wherein said cam edge corresponds substantially to the segment of a circle which rolls and pivots on said stationary mount, and said one face of said stationary mount is straight for said non-recessed portion over which said cam edge rolls and pivots.

3. In the switch of claim 1, wherein said portion of said cam connecting with said other end portion of said switch blade includes an integral platform portion to be engaged in a switching operation of said switch blade, and a recess below said platform connecting with said switch blade at said other end portion thereof.

4. In the switch of claim 1 wherein said cam has a recess at a portion spaced from said cam edge and said cam edge configuration corresponds to the segment of a circle which is described from a point rearwardly and downwardly from said recess.

5. In the switch of claim 1 wherein said linear dimension defines a path over which said cam edge moves, said cam and said stationary mount each having a structural portion spaced from said cam edge and said path respectively, and wherein each said structural portion cooperates with the other to prevent said cam from being displaced from said path when said switch is subjected to a severe shock load.

6. In the switch of claim 5 wherein the structural portion of said cam has pin means projecting from each side thereof adjacent said cam edge, and said stationary mount structural portion comprises projecting means projecting rearwardly from said other face to engage said pin means if said switch is subjected to a severe shock load and prevent displacement of said cam edge from said other face at said linear dimension.

7. In a snap action switch of the overcenter type having a stationary contact terminal and having a common terminal with two opposite faces, a depressible switch blade having two end portions with one of said end portions including a contact therewith and an integral tongue mounted at one face of said common terminal and the other end portion of said switch blade including a bridge therwith, the improvement comprising cam means for supporting said switch blade at said other end portion thereof operatively connected with said switch blade bridge and having a cam face portion of a configuration corresponding substantially to the segment of a circle engaging the other face of said common terminal in a face to face pivotal engagement, with said cam face adapted to roll on said other face over a linear dimension longitudinally of said common terminal and pivot at a plurality of points over said linear dimension when said switch blade is depressed with a switch operating force, said switch blade being tensioned upon said pivotal movement of said cam means, and said contact on said switch blade being moved from one position to another as said tensioning takes place.

8. In a snap action switch of the overcenter type having a housing, a tensionable switch blade with two end portions, a switch blade mounting member in said housing having two oppositely disposed mounting faces and with a portion of said switch blade mounted at a fixed pivot on one of said two mounting faces, and a plunger for operating said switch blade in a switching operation, the improvement comprising a pivotal cam connected with said switch blade at one end portion of said switch blade having a cam-shaped face spaced from said switch blade connection engaging the other mounting face of said switch blade mounting member, said cam-shaped face moving in a rolling movement over a linear path longitudinally of said other mounting face and pivoting at a plurality of points in said linear path corresponding to a plurality of positions of said switch blade when it is depressed by said operating plunger in a switching operation.

* * * * *